US007140525B2

(12) United States Patent
Ho

(10) Patent No.: US 7,140,525 B2
(45) Date of Patent: Nov. 28, 2006

(54) CAP FEEDING DEVICE FOR ROOFING GUNS

(75) Inventor: Arthur Ho, Ta-Li (TW)

(73) Assignee: Apach Industrial Co., Ltd., Taichung Hsien (TW)

( * ) Notice: Subject to any disclaimer, the term of this patent is extended or adjusted under 35 U.S.C. 154(b) by 27 days.

(21) Appl. No.: 11/004,976

(22) Filed: Dec. 7, 2004

(65) Prior Publication Data

US 2006/0118592 A1 Jun. 8, 2006

(51) Int. Cl.
*B25C 7/00* (2006.01)

(52) U.S. Cl. ..... 227/120; 227/114; 227/115

(58) Field of Classification Search ..... 227/120, 227/114, 115, 117, 138, 91
See application file for complete search history.

(56) References Cited

U.S. PATENT DOCUMENTS 3,935,873 A * 2/1976 Johnson ..... 453/41
4,023,255 A * 5/1977 Bussard et al. ..... 29/432.1
4,368,839 A * 1/1983 Okamura et al. ..... 227/91
4,657,167 A * 4/1987 Mays ..... 227/99
5,042,142 A * 8/1991 Beach et al. ..... 29/787
5,056,684 A * 10/1991 Beach et al. ..... 221/197
5,067,865 A * 11/1991 Zylka et al. ..... 411/531
5,339,983 A * 8/1994 Caple ..... 221/25
5,634,583 A * 6/1997 McGuinness et al. ..... 227/120
5,791,546 A * 8/1998 McGuinness et al. ..... 227/120
5,947,362 A * 9/1999 Omli ..... 227/120
6,065,660 A * 5/2000 Cabrera ..... 227/8
6,302,310 B1 * 10/2001 Lamb ..... 227/119
6,508,392 B1 * 1/2003 Huang ..... 227/18
6,543,666 B1 * 4/2003 Huang ..... 227/18
6,659,326 B1 * 12/2003 Huang ..... 227/18
6,837,412 B1 * 1/2005 Lamb ..... 227/18
6,918,523 B1 * 7/2005 Chou ..... 227/18

* cited by examiner

*Primary Examiner*—Sameh H. Tawfik
*Assistant Examiner*—Brian Nash
(74) *Attorney, Agent, or Firm*—Rosenberg, Klein & Lee

(57) ABSTRACT

A cap feeding device for a roofing gun includes a moving member and a pressing member which is pivotably connected to the moving member. Both of which are engaged with the rail unit of the container for receiving stack of caps. A torsion spring is biased between the two respective connection portions of the moving member and the pressing member. A coil spring has one end connected to the moving member and the other end of the coil spring is fixed to a bottom of the rail unit so that the moving member is movable along the rail unit. The caps can be directly pressed into the container and the user simply pulls the moving member upward till the pressing member pops outward to press on the top of the stack of the caps.

11 Claims, 5 Drawing Sheets

CAP FEEDING DEVICE FOR ROOFING GUNS

FIELD OF THE INVENTION

The present invention relates to a cap feeding device for a roofing gun wherein the stack of caps is conveniently pressed by a pressing member of the device which allows the caps to be inserted into the container directly without extra movement.

BACKGROUND OF THE INVENTION

U.S. Pat. Nos. 6,502,719B2, 6,508,392B1 and 6,543,666B1 respectively disclose a cap feeding device for roofing guns wherein the user has to open a lid or rotate a cover on a top of the container before inserting a stack of caps into the container. This is not convenient for the user to quickly insert the caps into the container.

U.S. Pat. Nos. 6,273,315B1 and 6,302,310B1 respectively disclose two improved feeding devices to simplify the steps for inserting caps into the container.

Nevertheless, the disclosures mentioned above involve a complicated structure which needs higher maintaining cost and manufacturing cost. Furthermore, all the feeding device have to pull the cap or lid assembly from the bottom of the container up to the top of the container such that the cap or the lid is able to be operated. After the caps are put in the container, the cap or the lid has to be pivoted to its original position. Obviously, too many steps required to re-load the caps.

SUMMARY OF THE INVENTION

The present invention relates to a cap feeding device for a roofing gun and the feeding device includes a moving member having a lever and a pressing member which is pivotably connected to the moving member. A limitation portion extends from the lever and a slot is defined between the limitation portion and a first connection portion of the moving member. A receiving portion is connected to the moving member and two second positioning members are connected to outside of the receiving portion. The pressing member includes a pressing portion which is biased by a torsion spring between the moving member and the pressing. A coil spring has one end engaged with the receiving portion of the moving member and the other end of the coil spring is engaged with the rail unit so that the moving member is movable along the rail unit and tends move downward such that the stack of caps is always pressed by the pressing member.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
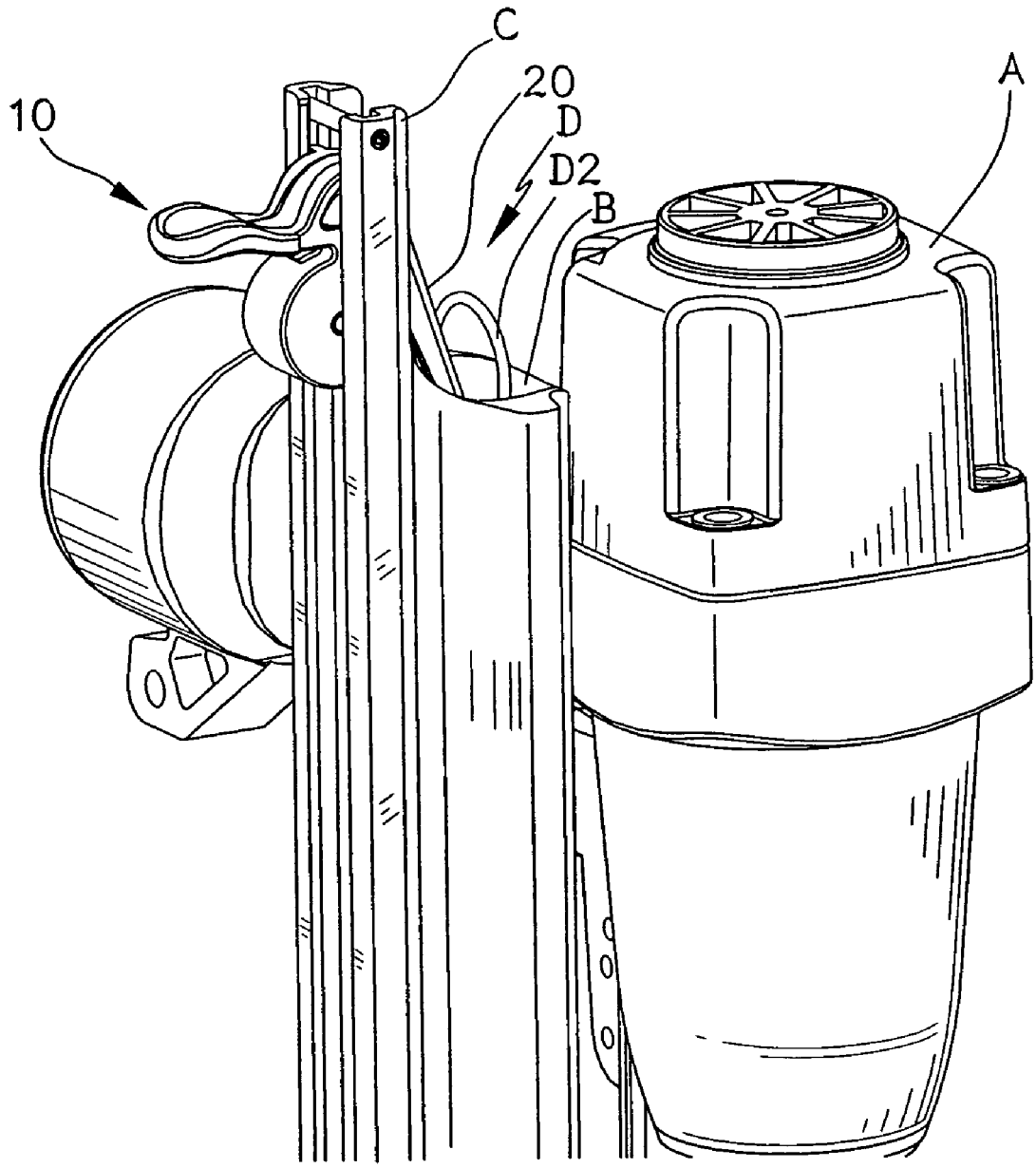
FIG. 1 shows the cap feeding device of the present invention connected to a roofing gun.
Figure 2:
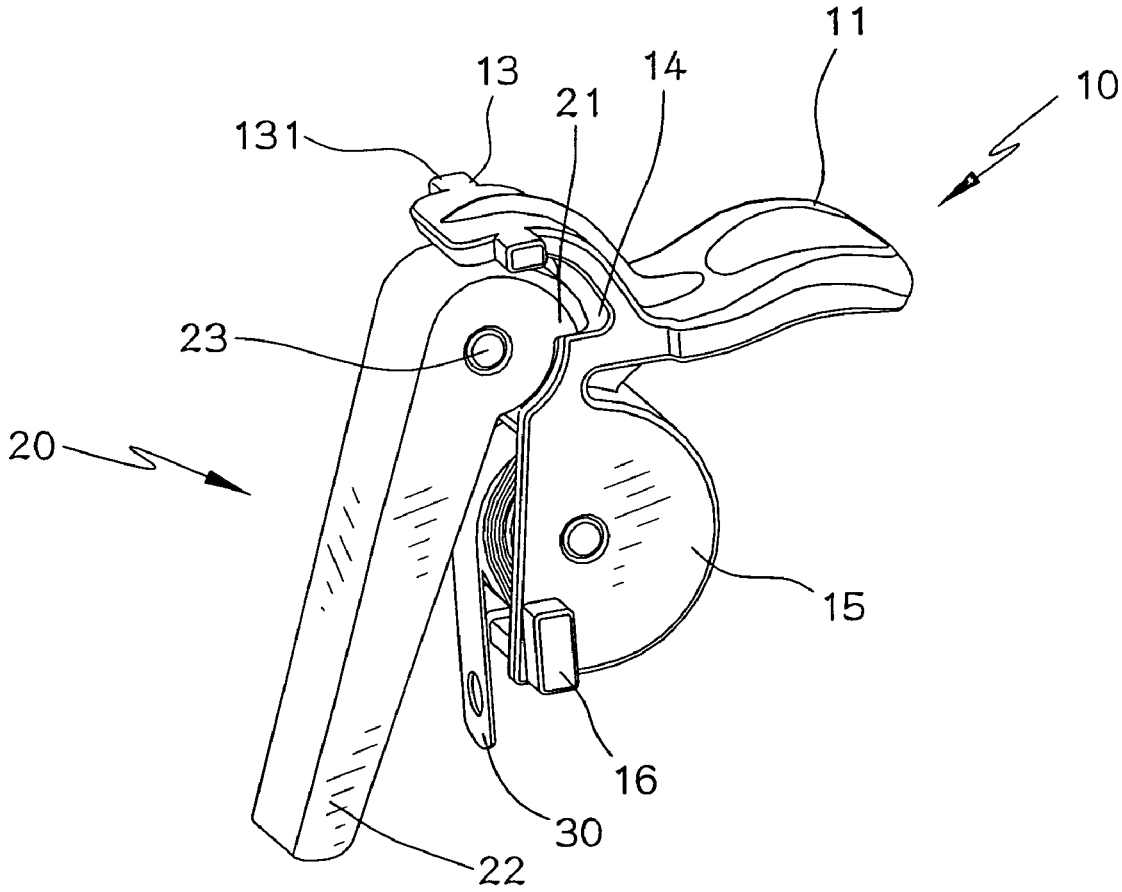
FIG. 2 shows the combination of the moving member and the pressing member of the cap feeding device of the present invention.
Figure 3:
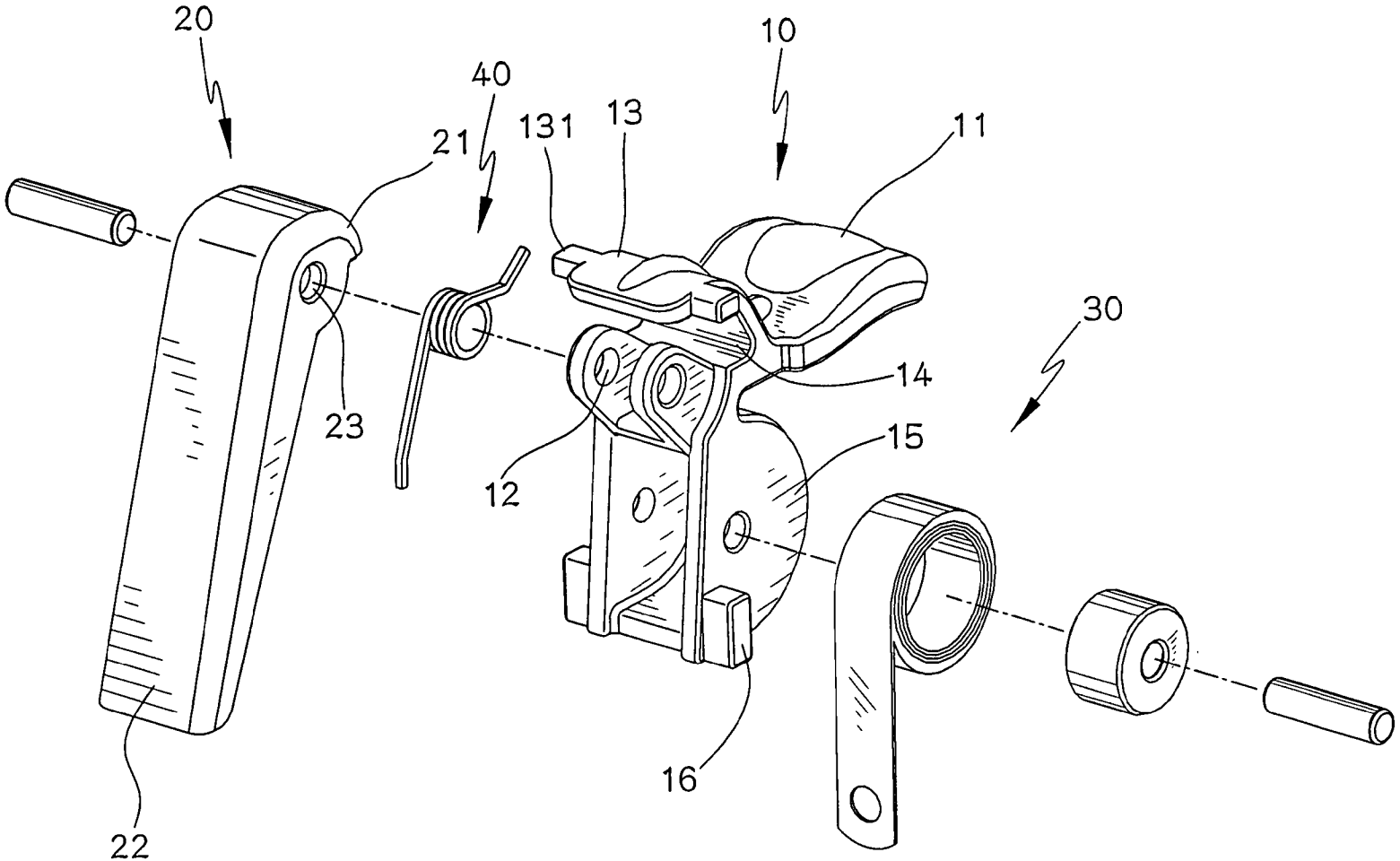
FIG. 3 is an exploded view to show the combination of the moving member and the pressing member of the cap feeding device of the present invention.

Referring to FIGS. 1 to 4, the cap feeding device of the present invention is connected to a container "B" on a side of the barrel "A" of the roofing gun. A stack of caps "D" is loaded into the container "B" which includes a rail unit "C".

The cap feeding device comprises a moving member 10 having a lever 11 which has a first connection portion 12 (two lugs in this embodiment) connected to an end of the lever 11. A plate-shaped limitation portion 13 extends from the lever 11 and located beside the first connection portion 12 so that a slot 14 is defined between the limitation portion 13 and the first connection portion 12. A pressing member 12 is pivotably engaged with the slot 14 and the limitation portion 13 limits the angle that the pressing member 12 is pivoted. The lever 11 can be operated manually to push the pressing member 20 outward when needed. A receiving portion 15 is connected to the moving member 10 and located opposite the first connection portion 12 and the limitation portion 13. The limitation portion 13 includes two first positioning members 131 and two second positioning members 16 are connected to outside of the receiving portion 15, the first and second positioning members 131, 16 are engaged with the rail unit "C" to guide the movement of the moving member 10 along the rail unit "C".

A coil spring 30 which is a strip spring and has one end engaged with the receiving portion 15 of the moving member 10 and the other end of the coil spring 30 is engaged with a bottom of the rail unit "C" so that the moving member 10 tends to be pulled downward.

The pressing member 20 is a U-shaped member and has a second connection portion 23 (two holes in this embodiment) at an end thereof and a pressing portion 22 at the other end of the pressing member 20. The pressing member 20 is pivotably connected to the moving member 10 by extending a pin through the first and second connection portions 12, 23. A pivot end 21 is connected to the second connection portion 23 and pivotably inserted in the slot 14 such that the limitation portion 13 limits the angle that the pressing member 12 is pivoted.

A torsion spring 40 includes two ends and is mounted to the pin extending through the first and second connection portions 12, 23, one of the two ends is in contact with the moving member 10 and the other end of the torsion spring 40 is in contact with the pressing member 20. Therefore, the pressing member 22 is pushed outward by the torsion spring 40. It is noted that the connection of the first and second connection portions 12, 23 can be any known method such as one of which is a C-shaped member and the other is a tubular member to be received in the C-shaped member. The second connection portion 23 of the pressing member 20 may have a protrusion for operating the pressing member 20 when no torsion spring 40 is installed.

Figure 4:
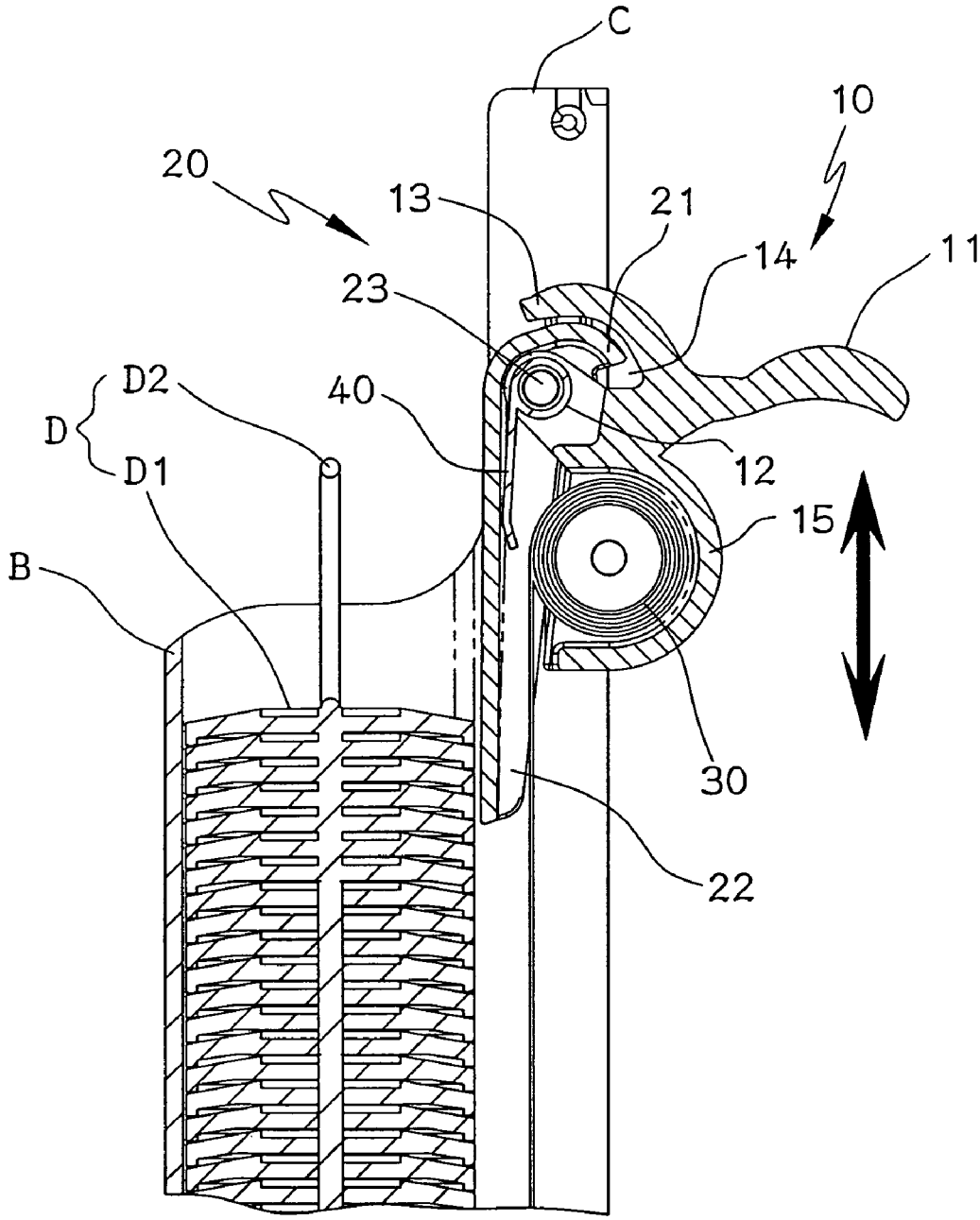
FIG. 4 shows the feeding device is pulled upward along the rail unit after the stack of caps is loaded in the container.
Figure 5:
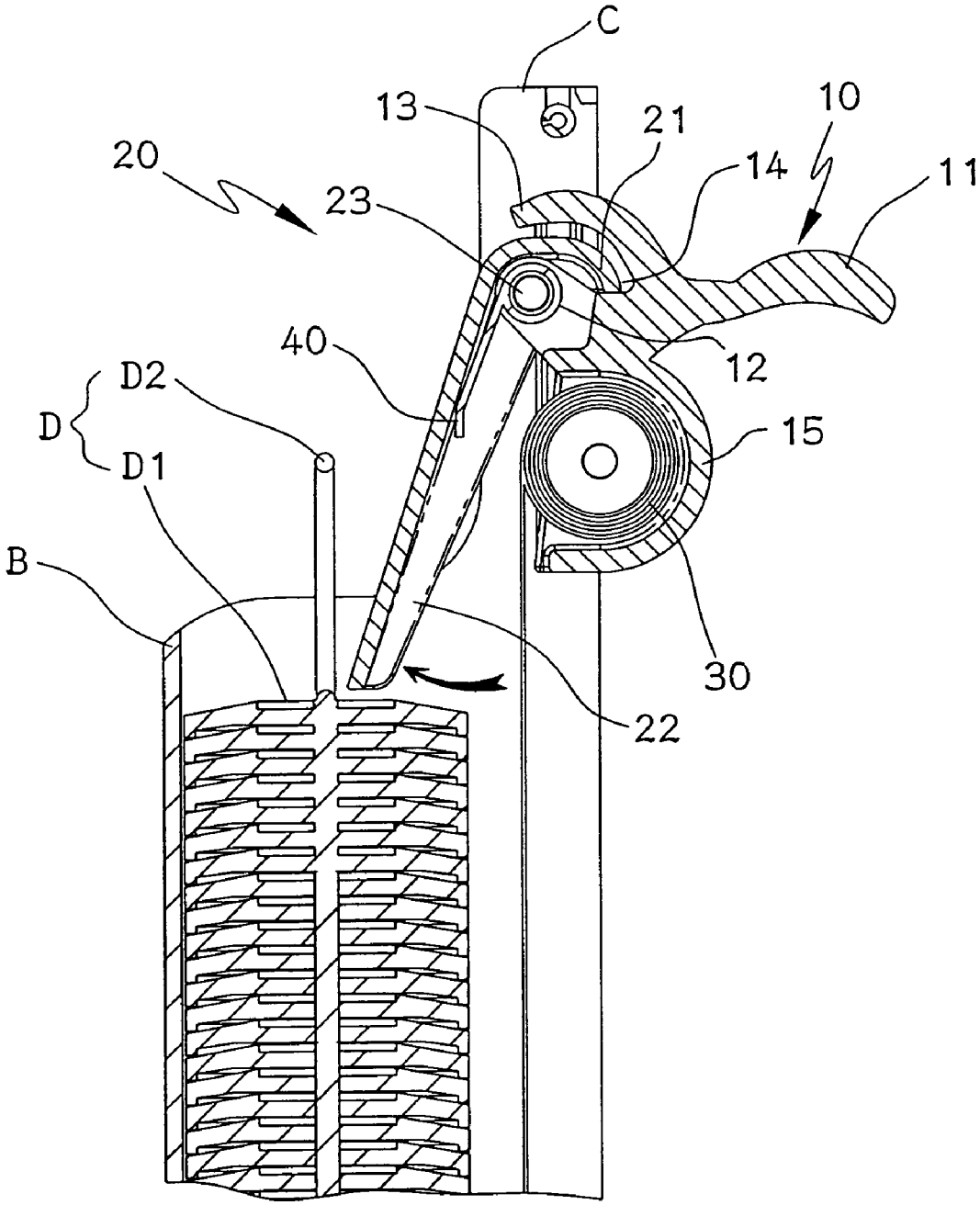
FIG. 5 shows that the pressing member is biased by a torsion spring and presses on a top of the stack of the caps.

As shown in FIGS. 4 and 5, a stack of caps "D" can be directly loaded into the container "B" and the pressing member 20 is pressed by the stack of the caps "D". The moving member 10 is then pulled upward along the rail unit "C" until the pressing member 20 is pushed by the torsion spring 40 and presses on the top most cap "D1". The connection wire "D2" extending through the stack of the caps "D" is then pulled out. Due to the coil spring 30, the moving member 10 together with the pressing member 20 tend to move downward so that the pressing member 20 always presses on the on the top most cap "D1". After the caps run out, the moving member 10 together with the pressing member 20 are located at the bottom of the container "B". A new stack of caps "D" is re-loaded into the container "B" without any extra step.

While we have shown and described the embodiment in accordance with the present invention, it should be clear to those skilled in the art that further embodiments may be made without departing from the scope of the present invention.

What is claimed is:

1. A cap feeding device for a roofing gun comprising:

a roofing gun having a cap container which is located adjacent a barrel of the roofing gun; the cap container having a rail unit and further comprising;

a moving member having a lever at a first end thereof and a first connection portion connected to a second end of the moving member;

a pressing member having a second connection portion at a first end thereof and a pressing portion connected to a second end of the pressing member, the first connection portion of the moving member being pivotably connected with the second connection portion of the pressing member; and a torsion spring connected between the moving member and the pressing member to urge the pressing member away from the moving member.

2. The device as claimed in claim 1, wherein the second connection portion of the pressing member has a protrusion for operating the pressing member.

3. The device as claimed in claim 1, wherein a receiving portion is connected to the first connection portion of the moving member and second positioning members are connected to an outside of the receiving portion.

4. The device as claimed in claim 3, wherein a coil spring is received in the receiving portion, the coil spring being a strip spring.

5. A cap feeding device for a roofing gun comprising:

a roofing gun having a cap container which is located adjacent a barrel of the roofing gun; the cap container having a rail unit and further comprising;

a moving member having a lever which has a first connection portion connected to an end of the lever, a limitation portion extending from the lever and located beside the first connection portion, a slot defined between the limitation portion and the first connection portion, a receiving portion connected to the moving member and located opposite the first connection portion and the limitation portion, two second positioning connected to outside of the receiving portion;

a pressing member having a second connection portion at an end thereof and a pressing portion at the other end of the pressing member, a pivot end connected to the second connection portion and engaged with the slot;

a coil spring having one end engaged with the receiving portion of the moving member and the other end of the coil spring adapted to be engaged with the rail unit, and a torsion spring having two ends and one of the two ends being in contact with the moving member and the other end of the torsion spring being in contact with the pressing member.

6. The device as claimed in claim 5, wherein the first connection portion includes two lugs.

7. The device as claimed in claim 5, wherein the limitation portion of the moving member is a plate so that the slot is defined between the plate-shaped limitation portion and the receiving portion.

8. The device as claimed in claim 7, wherein the limitation portion includes two first positioning members which are adapted to be engaged with the rail unit.

9. The device as claimed in claim 5, wherein the first connection portion of the moving member is pivotably connected with the second connection portion of the pressing member.

10. The device as claimed in claim 5, wherein the first connection portion of the moving member is pivotably mounted with the second connection portion of the pressing member.

11. The device as claimed in claim 5, wherein the coil spring is a strip spring and received in the receiving portion.

* * * * *